US011713738B2

(12) United States Patent
Grether et al.

(10) Patent No.: US 11,713,738 B2
(45) Date of Patent: Aug. 1, 2023

(54) FUEL FEED UNIT AND TWO-STROKE ENGINE HAVING A FUEL FEED UNIT

(71) Applicant: Andreas Stihl AG & Co. KG, Waiblingen (DE)

(72) Inventors: Michael Grether, Waiblingen (DE); Johannes Alber, Stuttgart (DE); Michael Raffenberg, Fellbach (DE); Hannes Frank, Ludwigsburg (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 17/866,374

(22) Filed: Jul. 15, 2022

(65) Prior Publication Data

US 2023/0013645 A1 Jan. 19, 2023

(30) Foreign Application Priority Data

Jul. 15, 2021 (EP) ..... 21185729

(51) Int. Cl.

| | |
|---|---|
| ***F02B 25/14*** | (2006.01) |
| ***F02M 35/10*** | (2006.01) |
| ***F02B 25/22*** | (2006.01) |
| ***F02M 35/108*** | (2006.01) |

(52) U.S. Cl.

CPC ..... *F02M 35/1019* (2013.01); *F02B 25/22* (2013.01); *F02M 35/108* (2013.01); *F02B 2710/034* (2013.01)

(58) Field of Classification Search

None

See application file for complete search history.

(56) References Cited

U.S. PATENT DOCUMENTS

| | | | | |
|---|---|---|---|---|
| 7,258,327 | B2 | 8/2007 | Prager | |
| 2005/0073062 | A1 | 4/2005 | Zwimpfer et al. | |
| 2006/0163755 | A1 | 7/2006 | Prager | |
| 2009/0013963 | A1 | 1/2009 | Eberhardt et al. | |
| 2012/0152216 | A1* | 6/2012 | Grether | F02B 25/14 123/65 P |

(Continued)

FOREIGN PATENT DOCUMENTS

| | | | |
|---|---|---|---|
| DE | 103 45 653 | A1 | 4/2005 |
| DE | 10 2005 003 559 | A1 | 8/2006 |

(Continued)

*Primary Examiner* — George C Jin
*Assistant Examiner* — Teuta B Holbrook
(74) *Attorney, Agent, or Firm* — Walter Ottesen, P.A.

(57) ABSTRACT

A fuel feed unit has a base body with an intake channel section, into which a fuel opening opens. A partition wall section divides the intake channel section into a mixture channel and an air channel. The wall section has a recess in which the throttle flap at least partially lies in an end position. The wall section has, upstream of the recess, a continuous surface facing the mixture channel and which has lateral sections adjacent to the channel wall and a middle section running between the lateral sections. The lateral sections have, upstream of the throttle flap, a separation edge for the flow. In the end position, the side of the throttle flap facing the mixture channel defines a reference plane which divides the unit into a first region and a second region. The lateral sections extend, at least directly upstream of the recess, into the second region.

22 Claims, 4 Drawing Sheets

(56) References Cited

U.S. PATENT DOCUMENTS

| | | | | |
|---|---|---|---|---|
| 2012/0152218 | A1 | 6/2012 | Grether et al. | |
| 2016/0169087 | A1* | 6/2016 | Yamazaki | F02B 25/20 123/73 A |
| 2020/0386192 | A1* | 12/2020 | Servatius | F02B 25/14 |
| 2021/0095619 | A1 | 4/2021 | Osburg et al. | |

FOREIGN PATENT DOCUMENTS

| | | | |
|---|---|---|---|
| DE | 10 2006 032 475 | A1 | 1/2008 |
| DE | 10 2010 054 838 | A1 | 6/2012 |
| DE | 103 62 394 | B3 | 3/2017 |
| EP | 1 740 819 | A1 | 1/2007 |
| JP | 2001295652 | A | 10/2001 |

* cited by examiner

FUEL FEED UNIT AND TWO-STROKE ENGINE HAVING A FUEL FEED UNIT

CROSS REFERENCE TO RELATED APPLICATION

This application claims priority of European patent application no. 21185729.7, filed Jul. 15, 2021, the entire content of which is incorporated herein by reference.

TECHNICAL FIELD

The disclosure relates to a fuel feed unit and to a two-stroke engine having a fuel feed unit.

BACKGROUND

U.S. Pat. No. 7,258,327 discloses a fuel feed unit, namely a carburetor, in which the intake channel in the carburetor is divided into a mixture channel and an air channel. For this purpose, a partition wall section is provided in the carburetor. In order, during the pivoting of the throttle flap from the completely open position into a closed position, to avoid uncontrolled leaning of the fuel/air mixture, means for dethrottling the mixture channel and/or for throttling the air channel are provided. For this purpose, the partition wall section may be beveled toward the throttle flap.

In particular in the completely open position of the throttle flap, the transfer of fuel into the air channel is intended to be avoided in such fuel feed units, which are provided in particular for two-stroke engines operating with a scavenging gas shield.

SUMMARY

It is an object of the disclosure to provide a fuel feed unit of the type in question which can be produced in a simple manner and achieves a good separation of the mixture channel and air channel in the second end position of the throttle flap.

To make it simple to produce the intake channel section and in order to permit a complete, defined closing of the throttle flap in the first end position, the intake channel section is conventionally machined in the region of the bearing points of the throttle shaft. The machining region conventionally goes beyond the bearing region of the throttle shaft in order to prevent the throttle flap from jamming and tilting in the regions in which the throttle flap protrudes close to the intake channel wall, even in the event of an unfavorable position of the manufacturing tolerances. In this region, between the intake channel wall and the throttle flap, a narrow connection opening is formed between the air channel and mixture channel. If the partition wall section protrudes into this region in order to close the connection opening, the partition wall section cannot be formed integrally with the base body of the fuel feed unit since otherwise the machining of the intake channel section in the region of the throttle shaft bearing is not, as previously, possible. When a partition wall section is formed separately and is pushed into the base body of the fuel feed unit, it has to be ensured that the partition wall section firstly protrudes as far as the throttle shaft and laterally as far as the intake channel wall, in order to permit good sealing, and secondly that the movement of the throttle shaft is not obstructed by the partition wall section. This makes the production of the fuel feed unit complicated.

It has now been shown that a complicated sealing between the throttle shaft and the partition wall section running upstream of the throttle shaft can be omitted and nevertheless a good operating performance achieved if the lateral sections of the throttle wall section extend, at least directly upstream of the recess in which the throttle flap lies in the end position, into the second region of the fuel feed unit.

The two regions of the fuel feed unit are produced if the fuel feed unit is conceptually divided at the reference plane into two parts via a plane. The throttle flap, when it is in the end position, is arranged in the first region. The end position of the throttle flap, in which the throttle flap lies at least partially in the recess, is the open end position of the throttle flap. In the end position, the throttle flap advantageously forms part of a partition wall which divides the intake channel into the mixture channel and the air channel. In the end position, the throttle flap advantageously substantially releases the flow cross section in the intake channel. The throttle flap advantageously has a further, closed end position, in which the throttle flap substantially closes the flow cross section in the intake channel.

Owing to the fact that the lateral sections extend directly upstream of the recess into the second region, the flow in the mixture channel is conducted away in the region of the lateral sections by the connection openings formed between the partition wall section and the throttle flap. A complicated sealing between the partition wall section and the throttle shaft can thereby be omitted and a transfer of fuel into the air channel in the end position of the throttle flap can be very substantially avoided.

The middle section of the partition wall is referred to below as the middle section. The lateral sections of the partition wall are referred to below as lateral sections.

The middle section and the lateral sections are sections of a continuous mixture channel surface, which faces the mixture channel, of the partition wall section and lie upstream of the recess. Accordingly, the mixture channel surface is not interrupted. Fuel can thus flow unobstructed from the middle section to the lateral sections. The lateral sections and the middle section are sections of the surface of the partition wall section, along which sections the mixture can flow in the second end position of the throttle flap, that is, the mixture channel surface. Upstream of the throttle flap, the lateral sections form a separation edge for the flow in the mixture channel. As a result, flow can be conducted from the middle section to the lateral sections and from there beyond the connection openings, which are formed in the partition wall section, between the throttle flap, intake channel wall and partition wall section. Owing to this configuration, the flow in the mixture channel advantageously does not flow through the connection openings into the air channel, but rather flows past the connection openings and remains in the mixture channel. The connection openings extend between the throttle flap, the partition wall and the intake channel wall. The connection openings have a substantially triangular shape, with one side of the triangle having a curved profile.

The flow flowing in the mixture channel is conducted via the throttle flap and does not strike against the end face of the throttle flap in the lateral sections. As a result, the flow in the mixture channel can readily be conducted via the connection openings. The mixture channel surface preferably does not drop in relation to the reference surface in the lateral sections in the flow direction, but rather runs parallel to the reference plane or rises in relation to the reference plane. As a result, mixture flowing in the lateral sections along the mixture channel surface is conducted beyond the connection openings.

In a particularly preferred configuration, the middle section lies at least partially in the first region. In the second end position of the throttle flap, the flow in the mixture channel thereby at least partially flows against the end face of the throttle flap. If the throttle flap is pivoted out of the completely open position, the portion of the end face of the throttle flap against which the mixture in the mixture channel flows increases continuously. Owing to the fact that the flow also flows against the end face in the second end position of the throttle flap, the change in the flow when the throttle flap is opened is comparatively small, and therefore a disturbance to the mixture formation due to abruptly changing pressure conditions at the fuel opening, in particular at a main fuel opening, is avoided. Mixture which flows against the end face of the throttle flap is at least partially conducted, because of the curvature of the end face of the throttle flap, in the direction of the lateral sections and from there beyond the connection openings.

The middle section at least in one region at least directly upstream of the recess is advantageously at a distance of at least 50% of the thickness of the throttle flap, in particular of at least 80% of the thickness of the throttle flap, from the reference plane. The middle section over a length which corresponds at least to 30%, advantageously at least 50%, of the diameter of the throttle flap, advantageously directly upstream of the recess for the throttle flap is at a smaller distance from a partition wall plane of the partition wall than the lateral sections. The length of the middle section is measured here parallel to the longitudinal center axis of the intake channel section.

The flow in the mixture channel can thereby be influenced in such a manner that no mixture or only very small amounts of mixture can enter the air channel via the connection openings and at the same time disturbances in the mixture formation during opening of the throttle flap from the second end position are avoided. In a particularly preferred configuration, the middle section over its entire length is at a smaller distance from the partition wall plane than the lateral sections. As a result, a comparatively large flow cross section can also be provided in the mixture channel. The lateral sections advantageously have an overall width of at least 5 mm, in particular at least 7 mm. The overall width of the lateral sections is the sum of the individual widths of the two lateral sections. The overall width is measured here perpendicularly to the longitudinal center axis of the intake channel section.

The lateral sections advantageously have an overall width of at least 50% of the smallest width of the mixture channel surface of the partition wall section, in particular at least 70% of the smallest width of the mixture channel surface of the partition wall section. The overall width and the smallest width are measured here perpendicularly to the longitudinal center axis.

The middle section advantageously has a width which is at least 30%, advantageously at least 50%, of the smallest width of the mixture channel surface of the partition wall section. The width of the lateral sections and of the middle section are measured here perpendicularly to the longitudinal center axis and at the mixture channel surface.

The lateral sections preferably run at an inclination to the reference plane at least directly upstream of the separation edge. The lateral sections can run here at an inclination to the reference plane in a section plane perpendicular to the longitudinal center axis. Alternatively or additionally, it is preferably provided that, in a sectional plane which contains the longitudinal center axis of the intake channel section and which runs perpendicularly to the pivot axis of the throttle flap, the lateral sections run at an inclination, specifically preferably rise in the flow direction in relation to the reference plane. The mixture in the mixture channel can thereby be effectively conducted away from the connection opening. The lateral sections are configured in particular in the form of ramps.

In an advantageous embodiment variant, it is provided that the separation edge extends over the entire width of the mixture channel surface of the partition wall section. In an alternative advantageous configuration, it can be provided that the mixture channel surface merges into the base of the recess for the throttle flap. In this region, a transition without a separation edge can be provided.

In an embodiment, the middle section is formed by a depression of the partition wall section. The depression preferably runs concavely in a sectional plane perpendicular to the longitudinal center axis of the intake channel section. However, a different profile of the depression may also be advantageous. In an advantageous embodiment variant, the base of the depression runs parallel to the longitudinal center axis of the intake channel section. The profile parallel to the longitudinal center axis of the intake channel section is provided in particular in a sectional plane perpendicular to the pivot axis of the throttle flap and parallel to the longitudinal center axis of the intake channel section. It can be provided in particular that the depression forms a section of the recess for the throttle flap.

In an embodiment, the lateral sections run in a radius in a section perpendicular to the longitudinal center axis of the intake channel section. The radius adjoins the intake channel wall and is at least 2 mm, in particular at least 3 mm. In comparison to known embodiments, the radius with which the partition wall section merges into the intake channel wall is thereby significantly increased. This enlarged radius is already sufficient to conduct the flow away from the connection openings.

In an embodiment, the lateral sections adjoin the middle section on both sides. In an alternative advantageous configuration, it can be provided that further sections extend between the lateral sections and the middle section, the further sections being able to be located in the first region or in the second region of the fuel feed unit.

A choke element is advantageously arranged upstream of the partition wall section. The choke element can preferably be a choke flap. In an open position of the choke flap and second end position of the throttle flap, the choke flap, partition wall section and throttle flap can advantageously form a virtually continuous partition wall between the mixture channel and air channel.

In a particularly advantageous manner, the partition wall section is formed integrally with the base body of the fuel feed unit. An interruption-free transition between the mixture channel surface of the partition wall section and the intake channel wall can thereby be produced in a simple manner. In addition, the integral formation of the partition wall section on the base body permits simple production. Owing to the raised lateral sections of the mixture channel surface, a transfer of mixture out of the mixture channel into the air channel through the connection openings formed between the intake channel wall, partition wall section and throttle flap can be substantially avoided. At the same time, a sufficiently large surface can be provided for the machining of the region of the intake channel section in which the throttle flap is mounted. This results both in it being possible to produce the fuel feed unit in a simple manner and also in advantageous properties during operation.

The fuel feed unit can preferably be used with a two-stroke engine, in particular with a two-stroke engine operating with a scavenging gas shield. The air channel section of the fuel feed unit preferably forms a part of an air channel of the two-stroke engine, which part serves for feeding fuel-free air for preliminary storage in transfer channels of the two-stroke engine. The mixture channel section forms a part of a mixture channel of the two-stroke engine, with which part mixture is advantageously fed into the crankcase interior of the two-stroke engine.

There is an independent inventive concept in the configuration of the middle section of the mixture channel surface.

It is known from DE 10 2005 003 559 A1 (corresponding to U.S. Pat. No. 7,258,327 and US2006/0163755), the entirety of which is incorporated by reference herein, to provide the partition wall section upstream of the throttle flap with a flattened portion. As a result, a flow flows against that end face of the throttle flap which is located in front in the flow direction, even when the throttle flap is fully open.

On the basis of DE 10 2005 003 559 A1, it is a further object of the disclosure to provide a fuel feed unit with good operating behavior.

This object can, for example, be achieved by a fuel feed unit according to various embodiments of the disclosure.

Owing to the fact that the middle section of the mixture channel surface at least directly upstream of the recess lies in the first region, the flow flows against that end face of the throttle flap which lies upstream in the flow direction when the throttle flap is open. As a result, during slight closing of the throttle flap from the completely open position, the flow conditions change less severely at the end face of the throttle flap. An uncontrolled leaning of the mixture during closing of the throttle flap can thereby be avoided. Owing to the fact that the lateral sections lie in the reference plane or in the second region, mixture is conducted beyond the connection openings and not in the direction of the connection openings. The portion of mixture passing into the air channel when the throttle flap is closed and when the throttle flap is opened can thereby be reduced in comparison to known configurations.

Particularly preferably, the lateral sections at least directly upstream of the recess lie in the second region, and therefore mixture flowing in the mixture channel is conducted via the connection openings.

The fuel feed unit is provided in particular in a two-stroke engine, preferably in the two-stroke engine in a handheld, advantageously a hand-carried work apparatus. The fuel feed unit is in particular a carburetor.

BRIEF DESCRIPTION OF THE DRAWINGS

The invention will now be described with reference to the drawings wherein.

DESCRIPTION OF THE PREFERRED EMBODIMENTS

Figure 1:
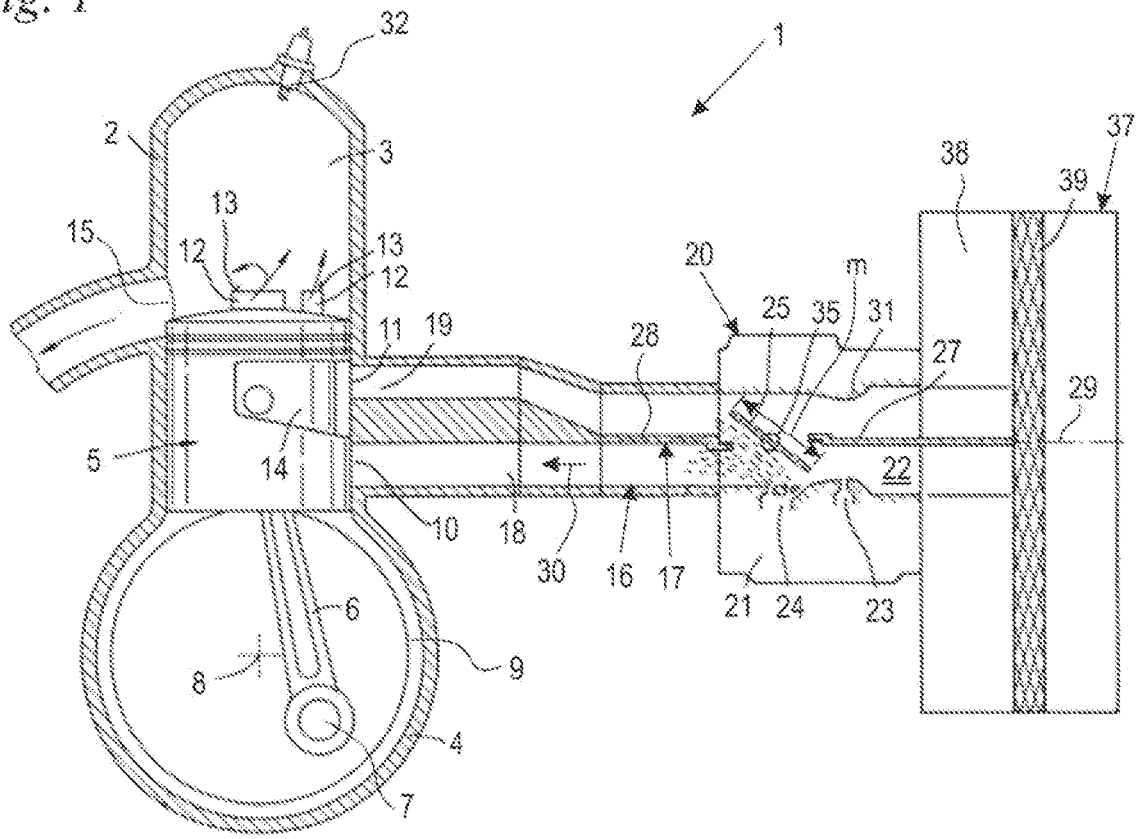
FIG. 1 shows a schematic illustration of a two-stroke engine operating with a scavenging gas shield.

FIG. 1 schematically shows a two-stroke engine 1. The two-stroke engine 1 can advantageously be provided as a drive motor in a work apparatus, in particular in a handheld work apparatus, for example a motorized saw, a cut-off grinder, a blowing apparatus, a brush cutter, a lawnmower or the like. The two-stroke engine 1 has a cylinder 2 in which a combustion chamber 3 is formed. A piston 5 is mounted in a reciprocating manner in the cylinder 2. The piston 5 uses a connecting rod 6 to drive a crankshaft 7, which is mounted in a crankcase interior 9 so as to be rotable about a rotational axis 8. The crankcase interior 9 is formed in a crankcase 4 and separated from the combustion chamber 3 by the piston 5. A discharge opening 15 for exhaust gases leads out of the combustion chamber 3. A spark plug 32 protrudes into the combustion chamber 3.

A mixture channel 18 with a mixture inlet 10 opens at the cylinder 2. The mixture inlet 10 opens into the crankcase interior 9 and, in the region of the upper dead center of the piston 5, is fluidically connected to the crankcase interior 9. The piston 5 preferably has at least one piston pocket 14. The two-stroke engine 1 has transfer channels 12 which, in the region of the lower dead center of the piston 5, fluidically connect the crankcase interior 9 to the combustion chamber 3. The transfer channels 12 open with transfer windows 13 at the cylinder bore.

The two-stroke engine 1 includes an air channel 19 which opens with an air inlet 11 at the cylinder bore of the cylinder 2. In the region of the lower dead center of the piston 5, the air inlet 11 is located in the region of the piston pocket 14 and connects the air channel 19 to the transfer windows 13 of the transfer channels 12. In the embodiment, four transfer channels 12 are provided, of which two are visible in the sectional illustration in FIG. 1. A different number and/or a different shape of transfer channels 12 may also be advantageous. The transfer channels 12 connect the crankcase interior 9 in the region of the lower dead center of the piston 5 to the combustion chamber 3 such that a fuel/air mixture can flow from the crankcase interior 9 via the transfer channels 12 into the combustion chamber 3. The transfer windows 13 are controlled by the piston 5 and, in the region of the lower dead center of the piston 5, are opened toward the combustion chamber 3.

The combustion air is sucked via an air filter 37. The air filter 37 has filter material 39 which separates a clean chamber 38 of the air filter 37 from the surroundings. The mixture channel 18 and the air channel 19 are connected to the clean chamber 38. Air is sucked up via an intake channel 16 which opens at the clean chamber 38 of the air filter 37.

The intake channel 16 is separated over at least part of its length into the air channel 19 and the mixture channel 18 by a partition wall 17.

A fuel feed unit 20 is provided for feeding fuel. The fuel feed unit 20 has a base body 21. An intake channel section 22 of the intake channel 16 is formed in the base body 21. The fuel feed unit 20 can be a carburetor which feeds fuel depending on the negative pressure prevailing in the intake channel section 22. In a preferred embodiment variant, the fuel feed unit 20 is a diaphragm-type carburetor. In an alternative preferred embodiment variant, it is provided that the fuel feed unit 20 includes a fuel valve which is opened and closed by a controller of the two-stroke engine 1. The fuel valve is in particular an electromagnetic valve, preferably a currentlessly open valve or a currentlessly closed valve. The fuel metered by the fuel valve is advantageously fed into the intake channel section 22 because of the negative pressure prevailing in the intake channel section 22.

A throttle flap 25 is arranged in the intake channel section 22. The throttle flap 25 is advantageously mounted pivotably with a throttle shaft 35. The throttle flap 25 has a diameter m. In the embodiment, the partition wall 17 has a partition wall section 27 upstream of the throttle shaft 35 and a partition wall section 28 downstream of the throttle shaft 35. The intake channel section 22 has a longitudinal center axis 29. The longitudinal center axis 29 is the axis which connects the geometric center points of the intake channel section 22 to one another at the upstream and downstream end faces of the base body 21. During operation, the combustion air and the fuel/air mixture flow in the intake channel 16 substantially in a flow direction 30 from the air filter 37 to the cylinder 2. In the event of return pulsations, a flow in the opposite direction may also take place. The partition wall 17 divides the intake channel 16 into the mixture channel 18 and the air channel 19. A main fuel opening 23 and a plurality of secondary fuel openings 24 in the fuel feed unit 20 open into the mixture channel 18. The main fuel opening 23 is arranged in the region of a venturi section 31.

Figure 2:
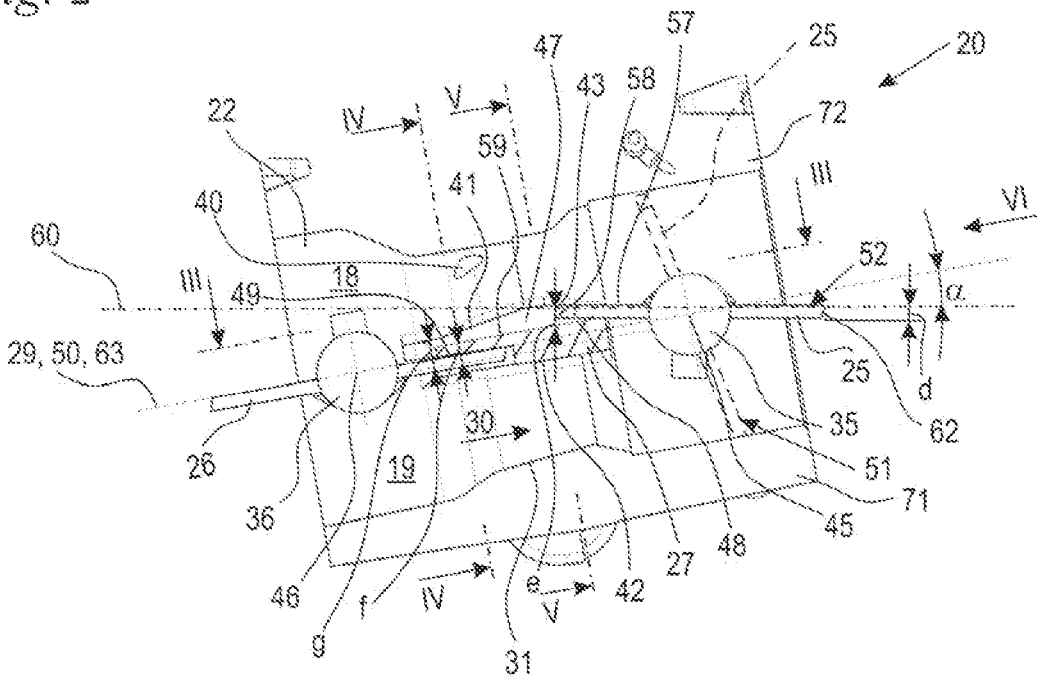
FIG. 2 shows a schematic sectional illustration through a fuel feed unit according to the disclosure.

FIG. 2 shows the fuel feed unit 20 schematically in detail in longitudinal section. The throttle flap 25 is mounted with the throttle shaft 35 pivotably about a pivot axis 45. As FIG. 2 shows, a choke flap 26 is arranged in the intake channel section 22 upstream of the throttle flap 25, with respect to the flow direction 30. The choke flap 26 is mounted with a choke shaft 36 so as to be pivotable about a pivot axis 46. In the embodiment, the longitudinal center axis 29 of the intake channel section 22 intersects the pivot axes 45 and 46. However, provision may also be made for the pivot axes 45 and 46 to be arranged offset with respect to the longitudinal center axis 29 in the intake channel section 22 and not to intersect the longitudinal center axis 29. The main fuel opening 23 is formed at a main fuel nozzle 40, which is illustrated in partially sectioned form in the sectional illustration in FIG. 2.

The intake channel section 22 has a center plane 50. The center plane 50 contains the longitudinal center axis 29 of the intake channel section 22 and runs parallel to the pivot axes 45 and 46. In the embodiment, the pivot axes 45 and 46 lie on the center plane 50.

FIG. 2 shows the choke flap 26 in its fully open end position. In this end position, a section of the choke flap 26 protrudes into a recess 49 of the partition wall section 27. The partition wall section 27 has a mixture channel surface 41. The mixture channel surface 41 of the partition wall section 27 is the surface which, in the illustrated end positions of the throttle flap 25 and choke flap 26, delimits the mixture channel 18. The partition wall section 27 has an air channel surface 42 which, in the illustrated end positions of the throttle flap 25 and choke flap 26, delimits the air channel 19. In the embodiment, the air channel surface 42 runs flat and approximately parallel to the center plane 50. In the embodiment, the choke flap 26 is in its fully open position parallel to the center plane 50.

The throttle flap 25 is pivotable between a first end position 51, illustrated by a dashed line, and the second end position 52, illustrated by a solid line. In the first end position 51, the throttle flap 25 substantially closes the flow cross section in the intake channel section 22. The first end position 51 preferably corresponds to the position of the throttle flap 25 when idling. In the first end position 51, the throttle flap 25 in the embodiment is arranged completely downstream of the partition wall section 27. In the second end position 52, the throttle flap 25 substantially opens up the flow cross section in the intake channel section 22. In the second end position 52, the throttle flap 25 encloses an angle $\alpha$ with the center plane 50. An upstream end face 58 of the throttle flap 25 lies on that side of the center plane 50 on which the mixture channel 18 runs. The downstream end face 62 of the throttle flap 25 lies on that side of the center plane 50 on which the air channel 19 runs. The angle $\alpha$ which the throttle flap 25 encloses with the center plane 50 may also be 0°. A small inclination of the throttle flap 25 in the opposite direction in its second end position 52 may also be provided.

On its side facing the mixture channel 18, the partition wall section 27 has a recess 48 into which the throttle flap 25 at least partially protrudes in its second end position 52. The partition wall section 27 and the throttle flap 25 overlap in the second end position 52, and therefore, in the second end position 52, the partition wall section 27 is not arranged completely upstream of the throttle flap 25. The partition wall section 27 is completely arranged upstream of the throttle shaft 35. In the embodiment, the partition wall section 27 has a depression 47 on its side facing the mixture channel 18. Owing to the depression 47, mixture flowing in the mixture channel 18 flows against that end face 58 of the throttle flap 25 which lies counter to the flow direction 30. In the embodiment, the depression 47 has a base 59 which runs in particular parallel to the longitudinal center axis 29. In the embodiment, the base 59 of the depression 47 runs closer to the air channel 19 than the end face 58, in the illustrated longitudinal section through the longitudinal center axis 29. The depression 47 is advantageously arranged in the middle section 53 of the partition wall section 27, which middle section faces the mixture channel 18.

In the embodiment, the throttle flap 25 protrudes with a circumferential region over its entire thickness d from the recess 48. However, provision may also be made for the end face 58 to protrude, in the second end position 52, only over part of the thickness d of the throttle flap 25 from the recess 48 into the mixture channel 18. The throttle flap 25 advantageously protrudes in a circumferential region by at least 50%, in particular by at least 80%, of its thickness d, from the recess 48.

The throttle flap 25 has a side 57 facing the mixture channel 18. The side 57 is a flat side of the throttle flap 25. In the second end position 52 of the throttle flap 25, mixture flows along the side 57 during operation. In the second end position 52, the side 57 delimits the mixture channel 18. The side 57 of the throttle flap 25 forms a reference plane 60, indicated in FIG. 2. In the position of the fuel feed unit 20 that is illustrated in FIG. 2, the reference plane 60, that is, also that side 57 of the throttle flap 25 which faces the mixture channel 18, is arranged horizontally, and the fuel opening 23 (FIG. 1) formed on the main fuel nozzle 40 is arranged above the partition wall section 27. In this position of the fuel feed unit 20, the middle section 53 of the mixture channel surface 41 runs below the reference plane 60.

The reference plane 60 divides the fuel feed unit into two regions, namely a first region 71 and a second region 72. In the first region 71, the throttle flap 25 is arranged in its second end position 52. In the embodiment, the partition wall section 27 runs in the first region 71. In the embodiment, the main fuel nozzle 40 is arranged in the second region 72. The air channel 19 advantageously runs in the first region 71.

At the edge of the recess 48, the middle section 53 is at a distance e, measured perpendicularly to the reference plane 60, from the reference plane 60. The distance e is advantageously at least 50%, in particular at least 80%, of the thickness d of the throttle flap 25. In a preferred configuration, the distance e corresponds at least to the thickness d. In the embodiment, the distance e is greater than the thickness d.

The partition wall 17 has a partition wall plane 63 which runs centrally in the partition wall 17. The partition wall plane 63 advantageously runs parallel to the center plane 50. In the embodiment, the partition wall plane 63 coincides with the center plane 50. The middle section 53 (FIG. 3) which, in the illustration in FIG. 2, runs through the sectional plane is at a smallest distance f, measured perpendicularly to the partition wall plane 63, from the partition wall plane 63. In the embodiment, the distance f over the entire length 1, measured parallel to the longitudinal center axis 29, of the middle section 53 (FIG. 3) is smaller than a distance g of the lateral sections 54 from the partition wall plane 63. The middle section 53 is advantageously at a distance f over a length 1 directly upstream of the recess 48 for the throttle flap 25 from the partition wall plane 63, the distance being smaller than a distance g of the lateral sections 54 from the partition wall plane 63. The length 1 advantageously corresponds to at least 30%, in particular at least 50%, of the diameter m of the throttle flap 25.

In the embodiment, the distance g of the lateral sections 54 from the partition wall plane 63 changes in the flow direction 30, as FIG. 2 shows. Accordingly, the lateral sections 54 do not run parallel to the partition wall plane 63. In the embodiment, the smallest distance f of the middle section 53 from the partition wall plane 63 is constant in the flow direction 30. The smallest distance f here is in each case the smallest distance of the middle section 53 from the partition wall plane 63 in each cross section perpendicular to the longitudinal center axis 29.

Figure 3:
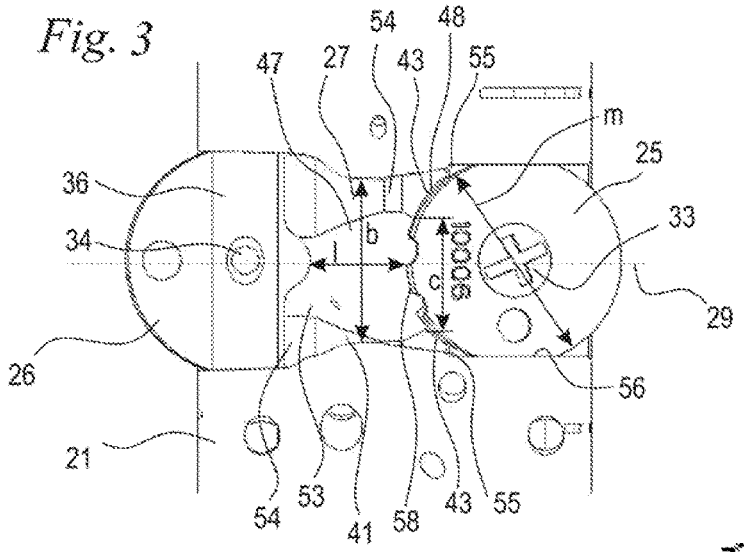
FIG. 3 shows a schematic sectional illustration, in detail form, along the line III-III in FIG. 2.

FIG. 3 shows the configuration of the partition wall section 27 in detail. The depression 47 extends from that side of the partition wall section 27 which faces the choke shaft 36 as far as the throttle flap 25 in its second end position 52. On the side facing the throttle flap 25, the depression 47 has a width c which is measured perpendicularly to the longitudinal center axis 29. The width c is measured on the mixture channel surface 41. The width c is advantageously at least 30%, in particular at least 50% of the smallest width b, measured in the same direction, of the mixture channel surface 41 of the partition wall section 27. The smallest width b of the mixture channel surface is measured on the mixture channel surface 41 from one to the opposite intake channel wall 56 and perpendicularly to the longitudinal center axis 29. In the embodiment, the smallest width b runs in the region of the venturi section 31. The depression 47 has a length 1 which is advantageously at least 30%, in particular at least 50%, of the diameter m of the throttle flap 25. The length 1 is measured here in a top view of the center plane 50 at the longitudinal center axis 29.

The depression 47 forms a middle section 53 of the mixture channel surface 41. Between the intake channel wall 56 and the middle section 53, lateral sections 54 extend on both sides of the middle section 53. In the embodiment, the lateral sections 54 directly adjoin the middle section 53. However, provision may also be made for further regions to be arranged between the lateral sections 54 and the middle section 53. The lateral sections 54 adjoin the intake channel wall 54 directly and without interruption.

At the lateral sections 54, the mixture channel surface 41 ends at a separation edge 43 upstream of the recess 48. The separation edge 43 delimits the recess 48. In the middle section 53, the depression 47 partially runs into the region of the throttle flap 25. The length 1 of the depression 47 corresponds to that length of the region of the middle section 53 which lies deeper than the lateral sections 54 with respect to the reference plane 60. In the embodiment, the depression 47 extends as far as the upstream side, facing the choke flap 26, of the mixture channel surface 41. The mixture channel surface 41 here is the surface of the partition wall 17 which is visible in the sectional illustration, shown in FIG. 3, in a top view of the side of the partition wall 17 facing the mixture channel 18 in the open end position of the throttle flap 25 and choke flap 26. The region of the partition wall 17 that is concealed by the throttle flap 25 in this view is not considered here to be part of the mixture channel surface 41.

Figure 3A:
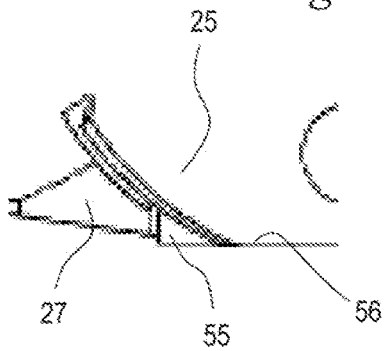
FIG. 3A shows an enlarged illustration, in detail form, of the region of the connection openings from FIG. 3.

As FIG. 2 shows, in the illustrated second end position 52 of the throttle flap 25, the mixture channel 18 and the air channel 19 are connected via connection openings 55. The connection openings 55 are each located between the throttle flap 25 and the intake channel wall 56 downstream of the partition wall section 27. Advantageously, the intake channel wall 56 is machined in the region of the connection openings 55 in order to avoid jamming of the throttle flap 25 during the opening and closing. The configuration of the connection openings 55 is also illustrated in the enlarged illustration in FIG. 3A.

As FIG. 3 also shows, the throttle flap 25 is fixed with a fastening element 33 to the throttle shaft 35 and the choke flap 26 is fixed with a fastening element 34 to the choke shaft 36. The fastening elements 33 and 34 are preferably screws.

Figure 4:
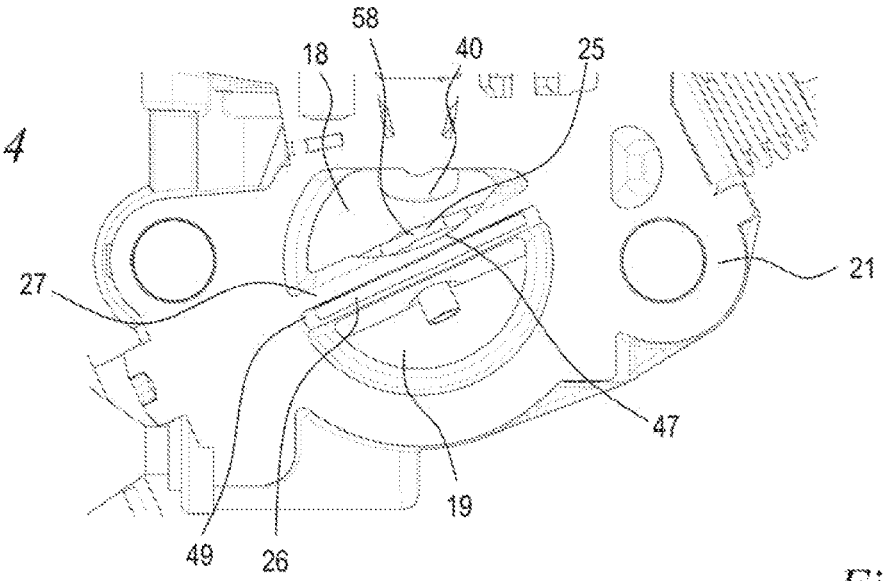
FIG. 4 shows a schematic sectional illustration, in detail form, along the line IV-IV in FIG. 2.
Figure 5:
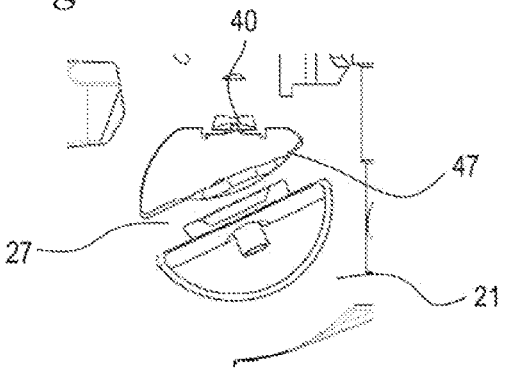
FIG. 5 shows a schematic sectional illustration, in detail form, along the line V-V in FIG. 2.

FIG. 4 shows the end face 58 of the throttle flap 25 in the region of the depression 47. As the illustration clarifies, the mixture in the mixture channel 18 flows against the end face 58. As FIGS. 4 to 6 show, the depression 47 runs concavely in longitudinal sections perpendicularly to the longitudinal center axis 29 of the intake channel 16.

Figure 6:
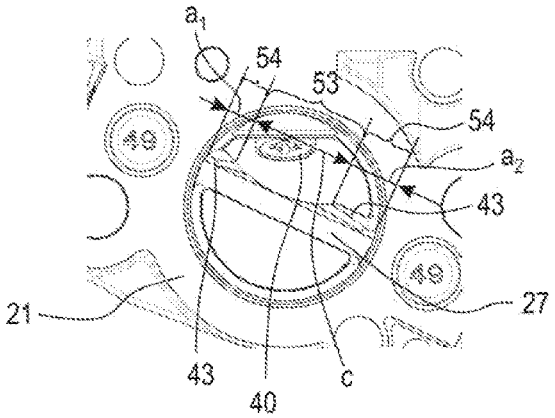
FIG. 6 shows a schematic view, in detail form, in the direction of the arrow VI in FIG. 2.

In FIG. 6, the profile of the lateral sections 54 and of the middle section 53 is visible. The lateral sections 54 each end at a separation edge 43. The middle section 53 extends over the width c which is advantageously at least 30%, in particular at least 50%, of the smallest width b of the mixture channel surface 41. The lateral sections 54 have a width $a_1$ and a width $a_2$. The widths $a_1$ and $a_2$ of the two lateral sections 54 can be identical or different in size. The lateral sections 54 have an overall width a which is the sum of the widths $a_1$ and $a_2$. The overall width a is advantageously at least 5 mm. The overall width a is advantageously at least 50%, in particular at least 70%, of the smallest width b of the mixture channel surface 41. The throttle flap 25 has a thickness d which is advantageously 0.5 mm to 3 mm.

Figure 7:
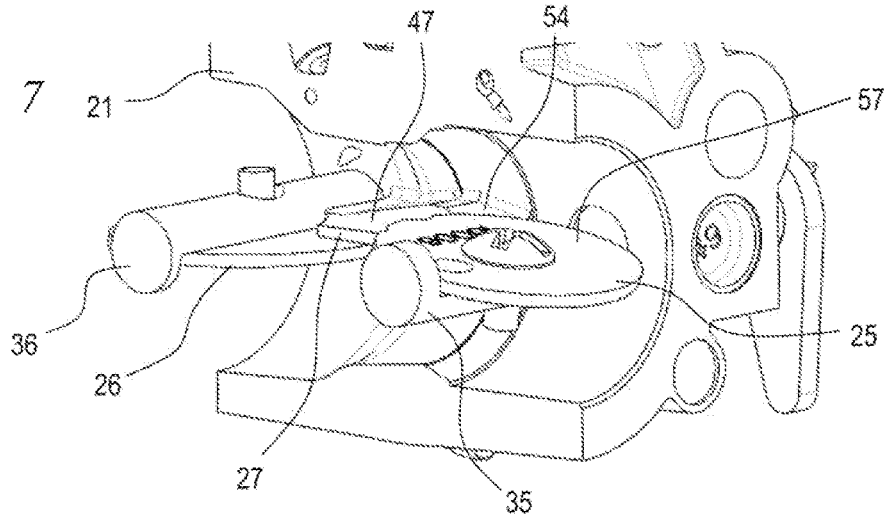
FIG. 7 and FIG. 8 show schematic perspective longitudinal sectional illustrations through the fuel feed unit from FIG. 2.
Figure 8:
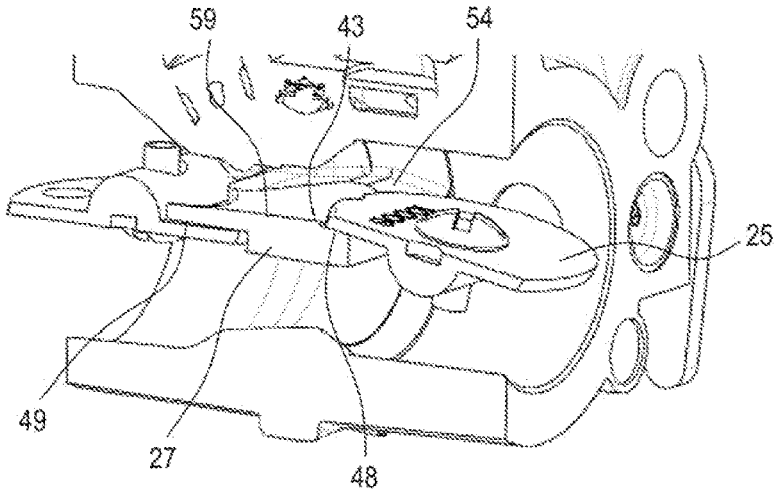

As FIGS. 7 and 8 show, the lateral sections 54 are flat in the region arranged upstream of the throttle flap 25. The separation edge 43 is located approximately at the same height as that side 57 of the throttle flap 25 which faces the mixture channel 18. Accordingly, the separation edge 43 advantageously lies in the reference plane 60.

The lateral sections 54 run in the reference plane 60 (see FIGS. 6 to 8). FIG. 8 also shows the configuration of the separation edge 43 on the middle section 53 at a distance from the longitudinal center axis 29.

Figure 9:
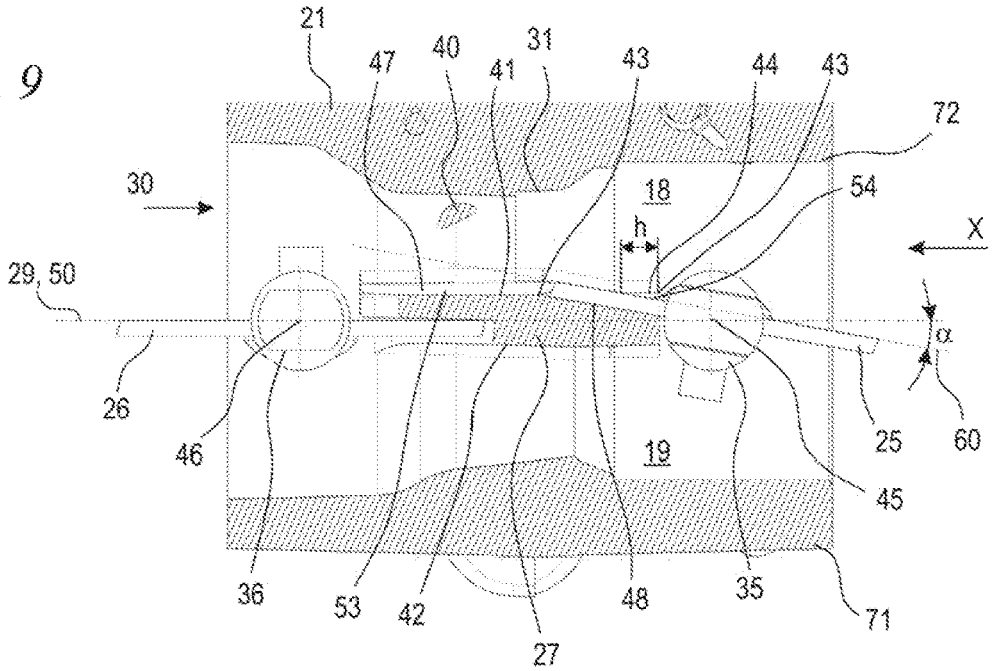
FIG. 9 shows a sectional illustration, in detail form, of an embodiment variant of the fuel feed unit.
Figure 10:
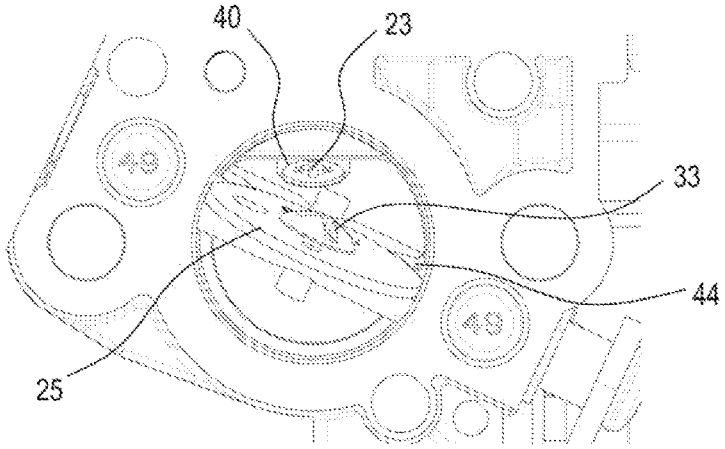
FIG. 10 shows a view, in detail form, in the direction of the arrow X in FIG. 9.

In the embodiment according to FIG. 9, a depression 47 is likewise provided on the partition wall section 27. The same reference signs denote mutually corresponding elements in all of the embodiments.

Figure 11:
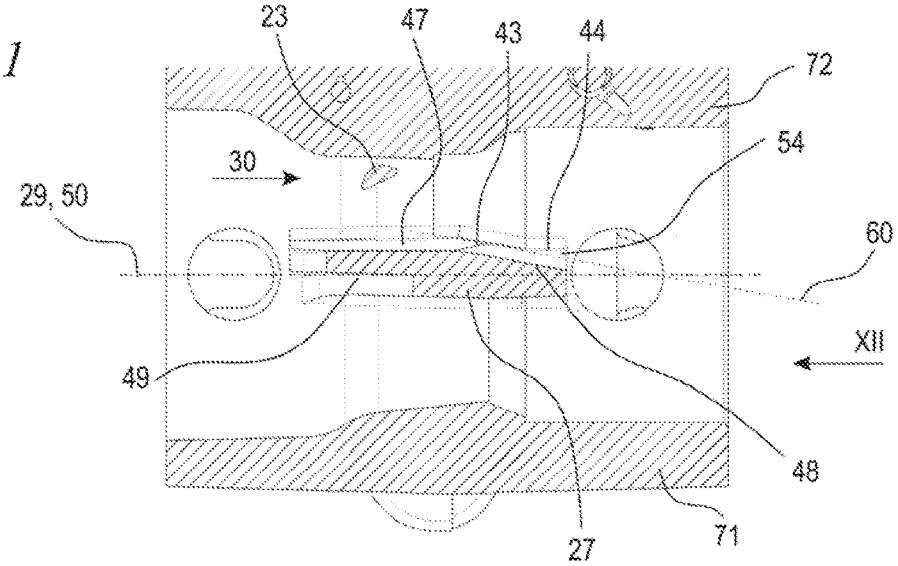
FIG. 11 shows the illustration from FIG. 9 without throttle flap, choke flap, throttle shaft and choke shaft; and, FIG. 12 shows a view, in detail form, in the direction of the arrow XII in FIG. 11.

In the embodiment according to FIG. 9, the depression 47 is less deep than in the previous embodiment. The separation edge 43 extends continuously over the entire width of the mixture channel surface 41. The lateral sections 54, as in particular FIG. 11 shows, extend upstream of the separation edge 43 in the second region 72. The main fuel nozzle 40 and the lateral sections 54 are advantageously arranged on the same side of the reference plane 60. The main fuel nozzle 40 and the lateral sections 54 are advantageously arranged in the second region 72. The lateral sections 54 are configured as guide elements 44. The lateral sections 54 run in the flow direction 30 at an inclination to the reference plane 60. As a result, the mixture is conducted away from the connection openings 55 shown in FIG. 3. The guide elements 44 are advantageously configured as ramps. In the embodiment, the lateral sections 54 run approximately parallel to the longitudinal center axis 29 and to the center plane 50. In the embodiment, the guide elements 44 run at an inclination with respect to the reference plane 60 by an angle $\beta$ which corresponds to the angle $\alpha$. The angle $\beta$ between the guide elements 44 and the reference plane 60 is advantageously at least 5°, in particular at least 10°: provision may also be made for the guide elements 44 to rise in the flow direction 30. A curved profile of the guide elements 44 may also be advantageous. The guide elements 44 advantageously extend in the first region 71 over a length h which is at least 3 mm, in particular at least 5 mm.

Figure 12:
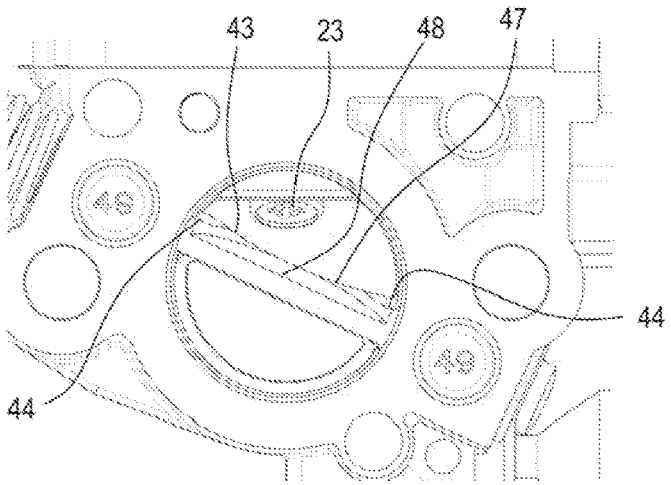

The guide elements 44 are also illustrated in FIG. 12.

The partition wall section 27 can preferably be formed integrally with the base body 21 of the fuel feed unit 20. The partition wall section 27 and the base body 21 are advantageously formed as an integral cast part. The fuel feed unit 20 is advantageously a carburetor, in particular a diaphragm-type carburetor. Metering fuel via an electromagnetic valve may also be advantageous.

It is understood that the foregoing description is that of the preferred embodiments of the invention and that various changes and modifications may be made thereto without departing from the spirit and scope of the invention as defined in the appended claims.

What is claimed is:

1. A fuel feed unit for feeding fuel to a two-stroke engine, the fuel feed unit comprising:

a base body having an intake channel section formed therein;

at least one fuel opening which opens into said intake channel section;

a throttle flap configured to control a free flow cross section of said intake channel section;

said throttle flap being mounted pivotably about a pivot axis;

a partition wall section extending in said intake channel section at least upstream of said throttle flap;

said partition wall section dividing said intake channel section into a mixture channel into which said fuel opening is configured to feed fuel and an air channel;

said partition wall section having a recess;

said throttle flap having an end position in which said throttle flap at least partially lies in said recess;

said partition wall section having, upstream of said recess, a continuous mixture channel surface which faces said mixture channel and which has lateral sections adjacent to said intake channel wall and a middle section running between said lateral sections;

said lateral sections having, upstream of the throttle flap, a separation edge for the flow in said mixture channel and, in the end position of said throttle flap, a side of said throttle flap, which faces the mixture channel, defining a reference plane which divides the fuel feed unit into a first region, in which said throttle flap is arranged, and a second region; and, said lateral sections extending, at least directly upstream of said recess, into said second region of the fuel feed unit.

2. The fuel feed unit of claim 1, wherein said mixture channel surface in said middle section lies at least partially in said first region.

3. The fuel feed unit of claim 2, wherein said throttle flap has a thickness (d); said middle section, at least in one region at least directly upstream of said recess, is at a distance (e) from the reference plane; and, said distance (e) is at least 50% of said thickness (d).

4. The fuel feed unit of claim 1, wherein:

said throttle flap has a diameter (m);

said intake channel defines a longitudinal center axis;

said partition wall defines a partition wall plane running centrally in said partition wall;

said middle section, over a length (l) directly upstream of the recess for said throttle flap, is at a distance (f) from said partition wall plane;

said length (l) is at least 30% of said diameter (m);

said lateral section is at a distance (g) from said partition wall plane;

said distance (f) is smaller than said distance (g); and, said length (l) is measured parallel to said longitudinal center axis of said intake channel section.

5. The fuel feed unit of claim 4, wherein said middle section has a total middle section length; and, said middle section is, over said total middle section length, at a smaller distance from said partition wall plane than said lateral sections.

6. The fuel feed unit of claim 1, wherein said intake channel defines a longitudinal center axis; and, said lateral portions have an overall width (a) of at least 5 mm, said overall width (a) being measured perpendicularly to said longitudinal center axis of said intake channel section.

7. The fuel feed unit of claim 1, wherein said intake channel defines a longitudinal center axis; said lateral sections have an overall width (a) of at least 50% of a smallest width (b) of said mixture channel surface of said partition wall section; and, said overall width (a) and said smallest width (b) are measured perpendicularly to said longitudinal center axis.

8. The fuel feed unit of claim 1, wherein said intake channel defines a longitudinal center axis; and, said middle section has a width (c) which is at least 30% of a smallest width (b) of said mixture channel surface of said partition wall section, said width (c) being measured perpendicularly to said longitudinal center axis.

9. The fuel feed unit of claim 1, wherein said lateral sections run at an inclination to said reference plane at least directly upstream of said separation edge.

10. The fuel feed unit of claim 1, wherein said separation edge extends over an entire width of said mixture channel surface of said partition wall section.

11. The fuel feed unit of claim 1, wherein said intake channel section defines a longitudinal center axis; and, said middle section is formed by a depression of said partition wall section, said depression running concavely in a sectional plane perpendicular to said longitudinal center axis.

12. The fuel feed unit of claim 11, wherein said depression has a base running parallel to said longitudinal center axis.

13. The fuel feed unit of claim 1, wherein said lateral sections adjoin said middle section on both sides.

14. The fuel feed unit of claim 1 further comprising a choke element arranged upstream of said partition wall section.

15. The fuel feed unit of claim 1, wherein said partition wall section is formed integrally with said base body.

16. The fuel feed unit of claim 1, wherein said partition wall section is an integral cast part with said base body.

17. The fuel feed unit of claim 1, wherein said middle section of said mixture channel surface at least directly upstream of said recess lies in said first region; and, said lateral sections lie in said reference plane or in said second region.

18. The fuel feed unit of claim 1, wherein said lateral sections at least directly upstream of said recess lie in said second region.

19. A fuel feed unit for feeding fuel to a two-stroke engine, the fuel feed unit comprising:

a base body having an intake channel section formed therein;

at least one fuel opening which opens into said intake channel section;

a throttle flap configured to control a free flow cross section of said intake channel section;

said throttle flap being mounted pivotably about a pivot axis;

a partition wall section extending in said intake channel section at least upstream of said throttle flap;

said partition wall section dividing said intake channel section into a mixture channel into which said fuel opening is configured to feed fuel and an air channel;

said partition wall section having a recess;

said throttle flap having an end position in which said throttle flap at least partially lies in said recess;

said partition wall section having, upstream of said recess, a continuous mixture channel surface which faces said mixture channel and which has lateral sections adjacent to said intake channel wall and a middle section running between said lateral sections;

said lateral sections having, upstream of the throttle flap, a separation edge for the flow in said mixture channel and, in the end position of said throttle flap, a side of said throttle flap which faces the mixture channel defining a reference plane which divides the fuel feed unit into a first region, in which said throttle flap is arranged, and a second region; and, said middle section, at least directly upstream of said recess, lying in said first region and said lateral sections lying in said reference plane or in said second region.

20. The fuel feed unit of claim 19, wherein said lateral sections at least directly upstream of said recess lie in said second region.

21. A two-stroke engine comprising:

a fuel feed unit for feeding fuel to the two-stroke engine, the fuel feed unit including a base body, a throttle flap, and a partition wall section;

said base body having an intake channel section formed therein;

said fuel feed unit further having at least one fuel opening which opens into said intake channel section;

said throttle flap configured to control a free flow cross section of said intake channel section;

said throttle flap being mounted pivotably about a pivot axis;

said partition wall section extending in said intake channel section at least upstream of said throttle flap;

said partition wall section dividing said intake channel section into a mixture channel into which said fuel opening is configured to feed fuel and an air channel;

said partition wall section having a recess;

said throttle flap having an end position in which said throttle flap at least partially lies in said recess;

said partition wall section having, upstream of said recess, a continuous mixture channel surface which faces said mixture channel and which has lateral sections adjacent to said intake channel wall and a middle section running between said lateral sections;

said lateral sections having, upstream of the throttle flap, a separation edge for the flow in said mixture channel and, in the end position of said throttle flap, a side of said throttle flap which faces the mixture channel defining a reference plane which divides the fuel feed unit into a first region, in which said throttle flap is arranged, and a second region; and, said lateral sections extending, at least directly upstream of said recess, into said second region of the fuel feed unit.

22. A two-stroke engine comprising:

a fuel feed unit for feeding fuel to a two-stroke engine, the fuel feed unit including a base body, a throttle flap, and a partition wall section;

said base body having an intake channel section formed therein;

said fuel feed unit further having at least one fuel opening which opens into said intake channel section;

said throttle flap configured to control a free flow cross section of said intake channel section;

said throttle flap being mounted pivotably about a pivot axis;

said partition wall section extending in said intake channel section at least upstream of said throttle flap;

said partition wall section dividing said intake channel section into a mixture channel into which said fuel opening is configured to feed fuel and an air channel;

said partition wall section having a recess;

said throttle flap having an end position in which said throttle flap at least partially lies in said recess;

said partition wall section having, upstream of said recess, a continuous mixture channel surface which faces said mixture channel and which has lateral sections adjacent to said intake channel wall and a middle section running between said lateral sections;

said lateral sections having, upstream of the throttle flap, a separation edge for the flow in said mixture channel and, in the end position of said throttle flap, a side of said throttle flap which faces the mixture channel defining a reference plane which divides the fuel feed unit into a first region, in which said throttle flap is arranged, and a second region; and, said middle section, at least directly upstream of said recess, lying in said first region and said lateral sections lying in said reference plane or in said second region.

* * * * *